US011773749B2

(12) United States Patent
Doiphode et al.

(10) Patent No.: US 11,773,749 B2
(45) Date of Patent: Oct. 3, 2023

(54) METHOD AND SYSTEM FOR NOZZLE RING REPAIR

(71) Applicant: Cummins Inc., Columbus, IN (US)

(72) Inventors: Nikhil Doiphode, Columbus, IN (US); Todd M. Wieland, Columbus, IN (US)

(73) Assignee: CUMMINS INC., Columbus, IN (US)

( * ) Notice: Subject to any disclaimer, the term of this patent is extended or adjusted under 35 U.S.C. 154(b) by 0 days.

(21) Appl. No.: 17/672,350

(22) Filed: Feb. 15, 2022

(65) Prior Publication Data

US 2022/0170384 A1 Jun. 2, 2022

Related U.S. Application Data

(62) Division of application No. 15/913,278, filed on Mar. 6, 2018, now abandoned.

(60) Provisional application No. 62/540,242, filed on Aug. 2, 2017.

(51) Int. Cl.

| | |
|---|---|
| ***F01D 25/24*** | (2006.01) |
| ***F01D 17/16*** | (2006.01) |
| ***F01D 25/00*** | (2006.01) |

(52) U.S. Cl.

CPC ..... *F01D 25/24* (2013.01); *F01D 17/165* (2013.01); *F01D 25/005* (2013.01); *F05D 2220/40* (2013.01); *F05D 2230/232* (2013.01); *F05D 2230/237* (2013.01); *F05D 2230/80* (2013.01)

(58) Field of Classification Search

CPC ..... F01D 25/24; F01D 17/162; F01D 25/005; F05D 2220/40; F05D 2230/237; F05D 2230/232; F05D 2230/80

See application file for complete search history.

(56) References Cited

U.S. PATENT DOCUMENTS

| | | | | |
|---|---|---|---|---|
| 4,657,476 | A * | 4/1987 | Berg | F01D 17/165 415/164 |
| 4,696,620 | A * | 9/1987 | Ruetz | F01D 9/026 415/164 |
| 4,726,744 | A * | 2/1988 | Arnold | F01D 17/165 415/164 |
| 4,924,581 | A | 5/1990 | Jakobsen | |
| 5,522,697 | A | 6/1996 | Parker et al. | |
| 6,471,470 | B2 * | 10/2002 | Yoshimura | F01D 17/165 415/163 |

(Continued)

FOREIGN PATENT DOCUMENTS

| | | | |
|---|---|---|---|
| EP | 0882545 | A2 | 12/1998 |
| KR | 10-2016-0015679 | A | 2/2016 |

*Primary Examiner* — Igor Kershteyn

(74) *Attorney, Agent, or Firm* — Faegre Drinker Biddle & Reath LLP

(57) ABSTRACT

A method and system are provided for repairing a nozzle ring having a defect adjacent a transition between a ring plate and an inner skirt of the nozzle ring, comprising: forming at least one cut to detach at least one of a portion of the inner skirt, a portion of the transition, and a portion of the ring plate, thereby forming a joint surface and removing at least a portion of the defect; providing a replacement ring including replacement components for the detached at least one of a portion of the inner skirt, a portion of the transition, and a portion of the ring plate; and attaching the replacement ring to the nozzle ring at the joint surface using one of brazing or welding.

20 Claims, 13 Drawing Sheets

(56) References Cited

U.S. PATENT DOCUMENTS

| | | | | |
|---|---|---|---|---|
| 6,763,587 | B2 * | 7/2004 | Jinnai | F01D 17/165 415/164 |
| 6,892,931 | B2 | 5/2005 | Steplewski et al. | |
| 7,396,204 | B2 * | 7/2008 | Shiraishi | F01D 17/165 415/164 |
| 10,105,778 | B2 * | 10/2018 | Arai | B23K 1/19 |
| 2004/0231327 | A1 | 11/2004 | Ohishi | |
| 2007/0199977 | A1 | 8/2007 | Pollard et al. | |
| 2009/0031564 | A1 | 2/2009 | Meier | |
| 2019/0040762 | A1 | 2/2019 | Doiphode et al. | |

* cited by examiner

METHOD AND SYSTEM FOR NOZZLE RING REPAIR

CROSS-REFERENCE TO RELATED APPLICATIONS

This application is a divisional application of U.S. patent application Ser. No. 15/913,278, entitled "NOZZLE RING REPAIR," filed on Mar. 6, 2019, which claims priority to U.S. Provisional Application Ser. No. 62/540,242, entitled "NOZZLE RING REPAIR," filed on Aug. 2, 2017, the entire disclosures of which being hereby expressly incorporated herein by reference.

TECHNICAL FIELD

The present disclosure relates generally to nozzle rings for a turbocharger and more particularly to methods of repairing a nozzle ring by cutting off a portion of the nozzle ring and brazing or welding a replacement component to repair the nozzle ring.

BACKGROUND

On many diesel engines, a turbocharger uses the exhaust gas exiting the engine to pressurize or boost the air stream into the engine air intake manifold, from which air is routed to one or more combustion chambers of the engine. More specifically, exhaust gas is routed to a turbine housing of the turbocharger to cause a turbine to rotate. The turbine is coupled to a radial air compressor impeller by a shaft such that when the turbine rotates, the impeller also rotates. Rotation of the compressor impeller draws intake air into the compressor housing and pressurizes the air by a desired amount before it is mixed with fuel and delivered to a combustion chamber of the engine.

The amount by which the air is pressurized or boosted may be controlled by regulating the amount of exhaust gas delivered to the turbine housing. A wastegate valve may be used for this purpose. Alternatively, some turbochargers (i.e., variable geometry turbochargers ("VGTs")) change the geometry of the exhaust passage to the turbine. In one type of VGT, the velocity of exhaust provided to the turbine is adjusted by controlling the width of a nozzle through which the exhaust must pass to turn the turbine. An actuator (pneumatic, mechanical, etc.) is controlled by the engine control unit ("ECU") to actuate, for example, a rod and yoke system which slides a nozzle ring and vanes relative to a fixed shroud plate. This movement varies the flow area for the exhaust gas to reach the turbine wheel blades. A small flow area increases the velocity, and therefore pressure of the exhaust against the turbine wheel, thereby increasing the speed of rotation of the wheel and correspondingly, the compressor impeller to boost the pressure of air delivered to the intake manifold of the engine.

The nozzle ring and vanes in the above-described VGT are exposed to very high temperatures and stresses, which may result in defects requiring repair. Thus, an improved approach to nozzle ring repair is needed.

SUMMARY

According to one embodiment, the present disclosure provides a method for repairing a nozzle ring having a defect adjacent a transition between a ring plate and an inner skirt of the nozzle ring, comprising: forming at least one cut to detach at least one of a portion of the inner skirt, a portion of the transition, and a portion of the ring plate, thereby forming a joint surface and removing at least a portion of the defect; providing a replacement ring including replacement components for the detached at least one of a portion of the inner skirt, a portion of the transition, and a portion of the ring plate; and attaching the replacement ring to the nozzle ring at the joint surface using one of brazing or welding. In one aspect of this embodiment, forming at least one cut comprises forming exactly one cut between an upper surface and a lower surface of the ring plate to detach the inner skirt, the transition and a portion of the ring plate. In another aspect, forming at least one cut comprises forming a first cut into the inner skirt from an upper surface of the ring plate and forming a second cut into the inner skirt from an outer surface of the inner skirt to intersect the first cut to detach a portion of the inner skirt, the transition and a portion of the ring plate. In yet another aspect, forming at least one cut comprises forming a first cut into the inner skirt from an inner surface of the inner skirt, forming a second cut along the inner skirt, and forming a third cut into the inner skirt from an outer surface of the inner skirt in a plane of a lower surface of the ring plate to remove a portion of the inner skirt. In still another aspect of this embodiment, forming at least one cut comprises forming a first cut into the inner skirt from an inner surface of the inner skirt, forming a second cut along the inner skirt, and forming a third cut into the inner skirt from an outer surface of the inner skirt in a plane below a plane of a lower surface of the ring plate to remove a portion of the inner skirt. In yet another aspect, forming at least one cut comprises forming exactly one cut between the transition and a transition between an outer surface of the inner skirt and a lower surface of the ring plate to remove the inner skirt and a portion of the transition. In yet another aspect, forming at least one cut comprises forming exactly one curved cut into the inner skirt from an upper surface of the ring plate and out of the inner skirt in a plane substantially the same as a plane of an outer surface of the inner skirt to remove the transition and substantially all of the inner skirt. Another aspect of this embodiment further comprises pre-cleaning the nozzle ring before forming the at least one cut. Another aspect further comprises treating the nozzle ring to harden a surface of the nozzle ring after attaching the replacement ring. Yet another aspect of this embodiment further comprises treating the replacement ring to harden the replacement ring before attaching the replacement ring to the nozzle ring. In another aspect, attaching the replacement ring comprises using one of brazing or welding.

According to another embodiment, a nozzle ring for a turbocharger is provided, comprising: a ring plate having a plurality of vanes depending therefrom; and an inner skirt attached to the ring plate at a joint formed by one of brazing or welding. In one aspect of this embodiment, the inner skirt includes a transition between an outer surface of the inner skirt and an upper surface of the ring plate. In another aspect, the joint includes a joint surface extending between an upper surface and a lower surface of the ring plate. In another aspect, the joint includes a joint surface extending into the inner skirt from an upper surface of the ring plate and into the inner skirt from an inner surface of the inner skirt. In yet another aspect, the joint includes a joint surface extending from an inner surface of the inner skirt, along the inner skirt, and into the inner skirt from an outer surface of the inner skirt in a plane of a lower surface of the ring plate. In still another aspect of this embodiment, the joint includes a joint surface extending into the inner skirt from an inner surface of the inner skirt, along the inner skirt, and into the inner skirt from an outer surface of the inner skirt in a plane below a plane of a lower surface of the ring plate. In another aspect, the joint includes a joint surface extending from a transition between an inner surface of the inner skirt and an upper surface of the ring plate to a transition between an outer surface of the inner skirt and a lower surface of the ring plate. In another aspect, the joint includes a joint surface extending from an upper surface of the ring plate and out of the inner skirt in a plane substantially the same as a plane of an outer surface of the inner skirt. In still another aspect, the joint is formed by brazing using one of a Nickle-based braze material or Copper-based braze material.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

DETAILED DESCRIPTION

The embodiments disclosed below are not intended to be exhaustive or to limit the invention to the precise forms disclosed in the following detailed description. Rather, the embodiments are chosen and described so that others skilled in the art may utilize their teachings.

Figure 1:
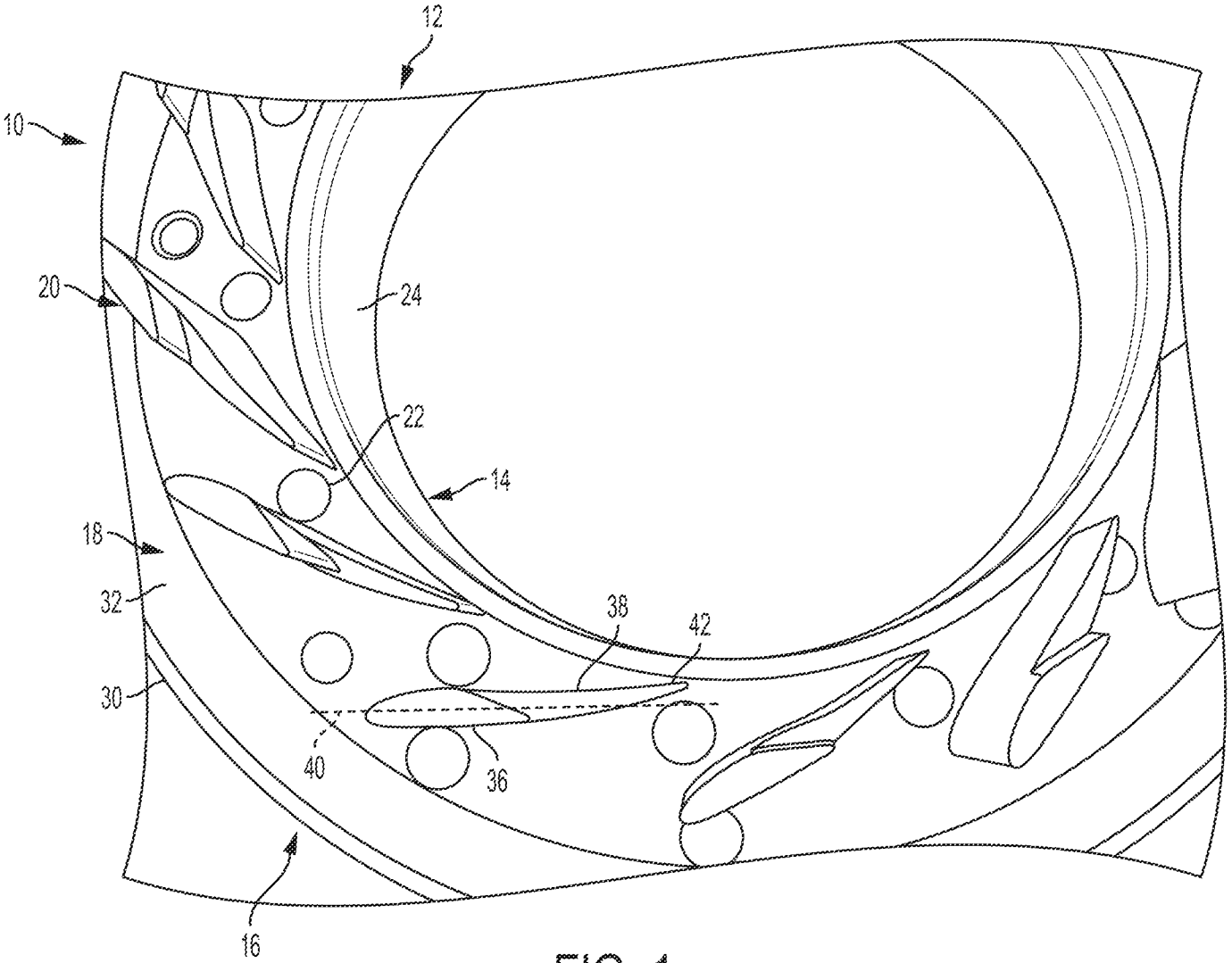
FIG. 1 PRIOR ART
FIGS. 1 and 2 are perspective views of a nozzle ring for a turbocharger.
Figure 2:
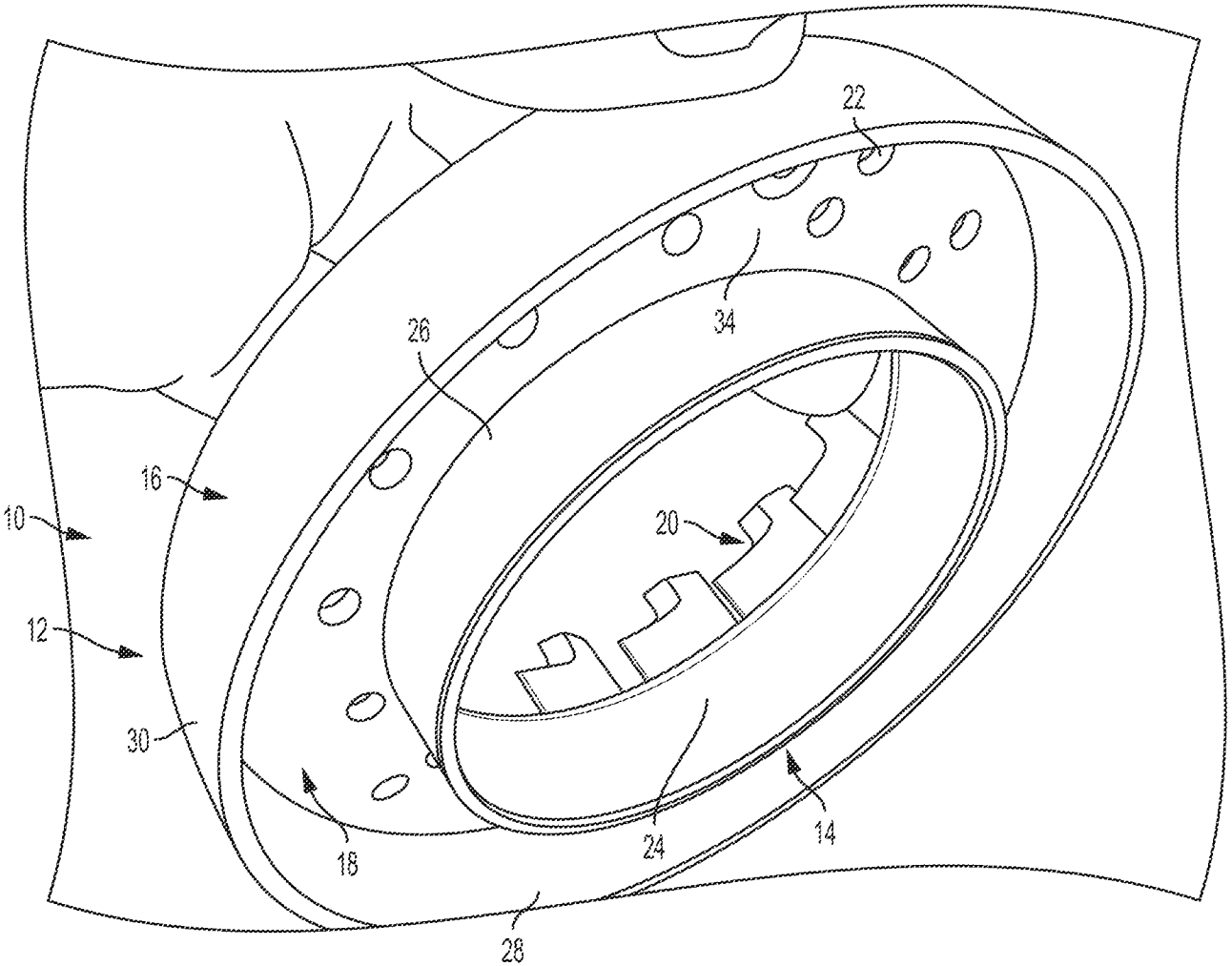
FIG. 2 PRIOR ART

Referring now to FIGS. 1 and 2, a nozzle ring 10 is shown. Nozzle ring 10 generally includes a body 12 having an inner skirt 14 and an outer skirt 16 connected together by a ring plate 18. A plurality of vanes 20 extend away from an upper surface 32 of ring plate 18. A plurality of openings 22 are formed through ring plate 18.

In certain embodiments, inner skirt 14 is generally cylindrical in shape, having an inner surface 24 and an outer surface 26 facing outer skirt 16. Similarly, outer skirt 16 is generally cylindrical in shape, having an inner surface 28 facing inner skirt 14 and an outer surface 30. Ring plate 18 is shaped like a generally flat ring, spanning between inner skirt 14 and outer skirt 16. Ring plate 18 includes upper surface 32 and a lower surface 34.

As best shown in FIG. 1, vanes 20 are directed inwardly toward inner skirt 14 and include a forward portion 36 and a rearward portion 38 which together form a slightly curved guide for the exhaust air being delivered to the turbine wheel (not shown) disposed within inner skirt 14. The forward portion 36 extends farther from ring plate 18 than rearward portion 38 and forms an increased width leading edge of vane 20 in the shape of an air foil. Rearward portion 38 sweeps slightly inwardly relative to a longitudinal axis 40 of vane 20 and terminates in a tip edge 42 positioned adjacent inner skirt 14.

Figure 3:
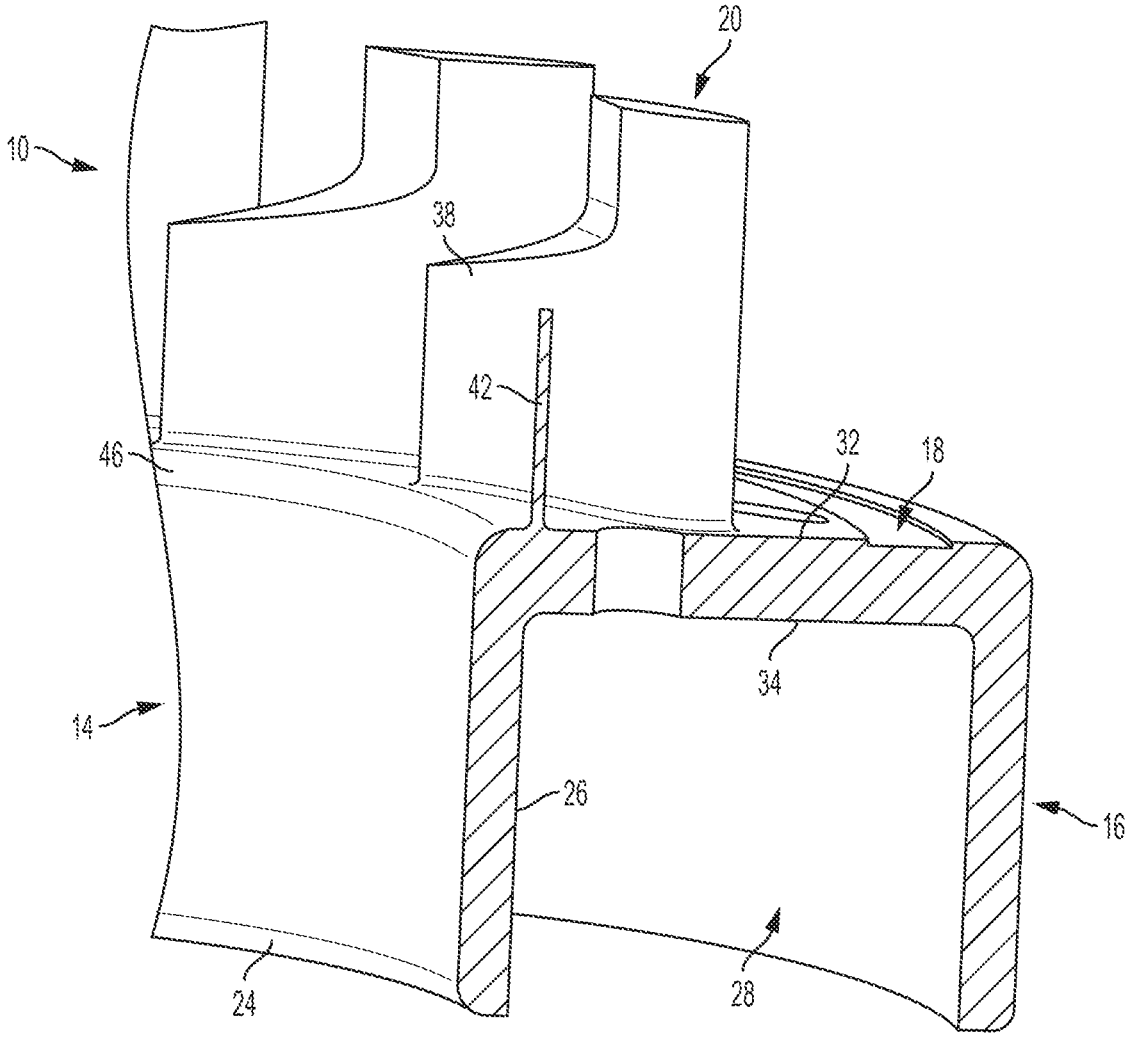
FIG. 3 PRIOR ART
FIG. 3 is a cross-sectional view of a nozzle ring.

Referring now to FIG. 3, a cross-sectional view of nozzle ring 10 is shown. The section is to best illustrate the area where defects may commonly occur. More specifically, the section has been taken adjacent tip edge 42 of rearward portion 38 of a vane 20, and shows upper surface 32 and lower surface 34 of ring plate 18, inner surface 24 and outer surface 26 of inner skirt 14, and transition 46. According to embodiments of the disclosure described below, inner skirt 14, transition 46 and/or a portion of ring plate 18 is/are removed from nozzle ring 10 to remove defect(s). New or refurbished components are then attached to nozzle ring 10 to repair nozzle ring 10 using brazing or welding as described herein.

Figure 4:
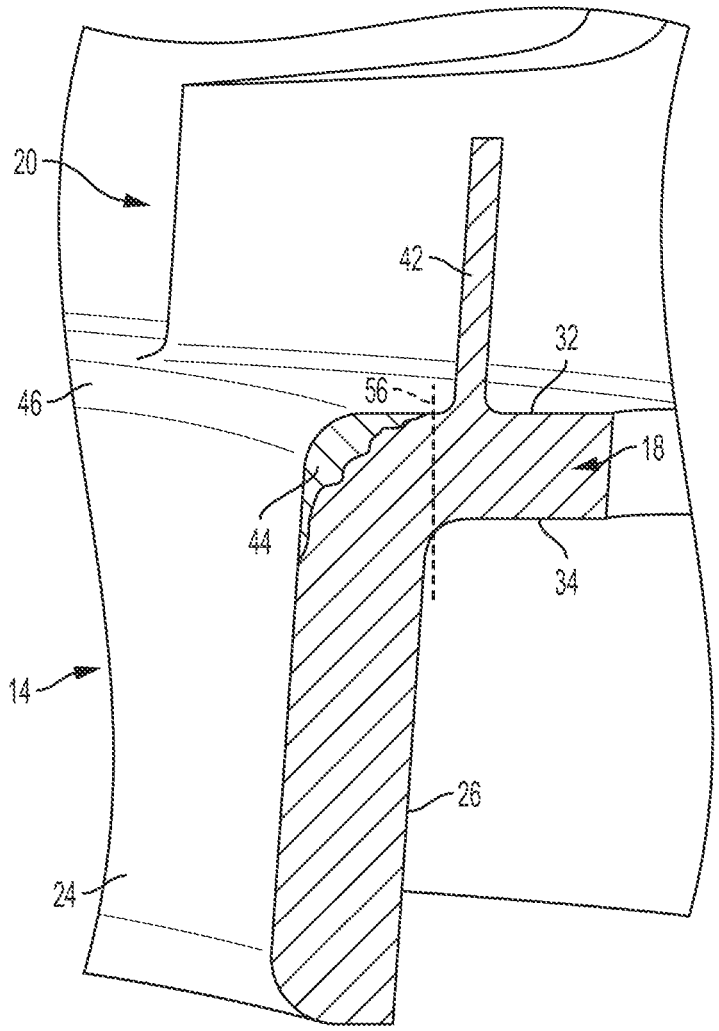
FIG. 4 is a cross-sectional view of a nozzle ring depicting a cut according to one embodiment of the present disclosure.
Figure 5:
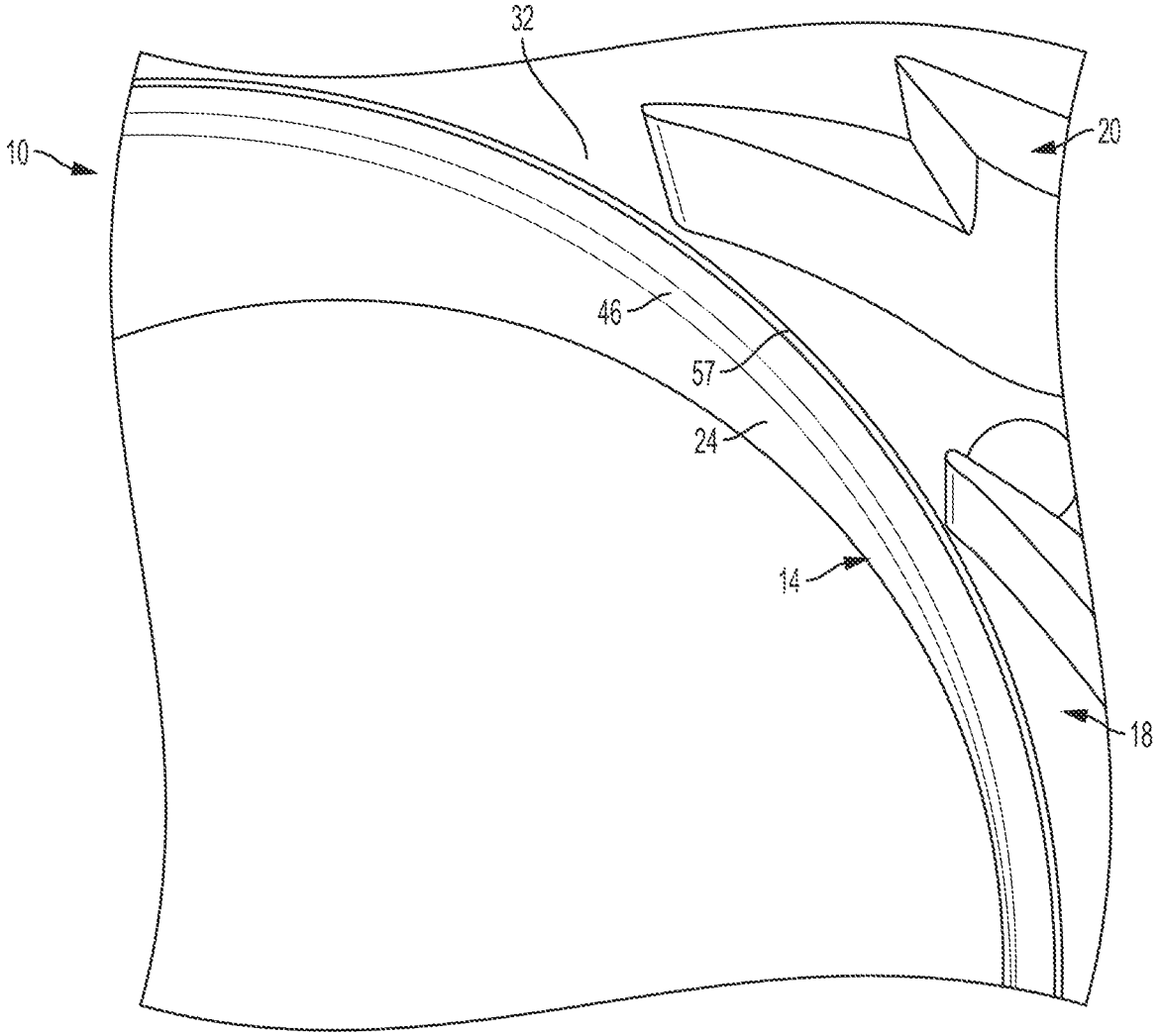
FIG. 5 is a perspective view of a nozzle ring repaired using the cut embodiment of FIG. 4.

FIG. 4 shows one embodiment of a method according to the present disclosure wherein a cut 56 is formed from upper surface 32 of ring plate 18 to lower surface 34 of ring plate 18, and extends around the entire circumference of inner skirt 14. Cut 56 removes a portion of ring plate 18, all of transition 46 and all of inner skirt 14 from nozzle ring 10. Cut 56 may be appropriate for removing substantially all of defects 44 that extend very near tip edge 42 of vanes 20. A lathe tool may be used to create cut 56 by plunging downwardly into inner skirt 14 and moving along a circular path through transition 46 such that the outer diameter of the tool path corresponds to the dashed line indicating cut 56. As is further described herein, a replacement ring (inner skirt 14, transition 46 and a portion of ring plate 18) may be fabricated as a new component or harvested from another nozzle ring that was scrapped for one of various reasons not affecting the replacement ring components. The replacement ring is attached to the remainder of nozzle ring 10 by brazing or welding, as is further described below. The braze bead 57 is shown on a repaired nozzle ring 10 in FIG. 5.

Figure 6:
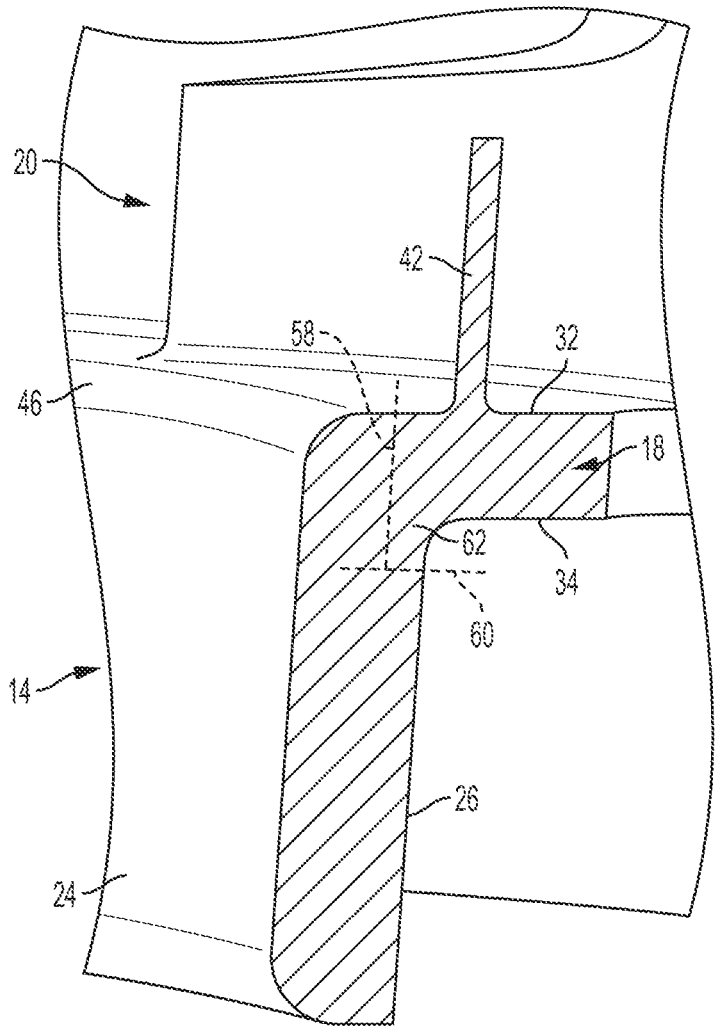
FIG. 6 is a cross-sectional view of a nozzle ring depicting cuts according to another embodiment of the present disclosure.
Figure 7:
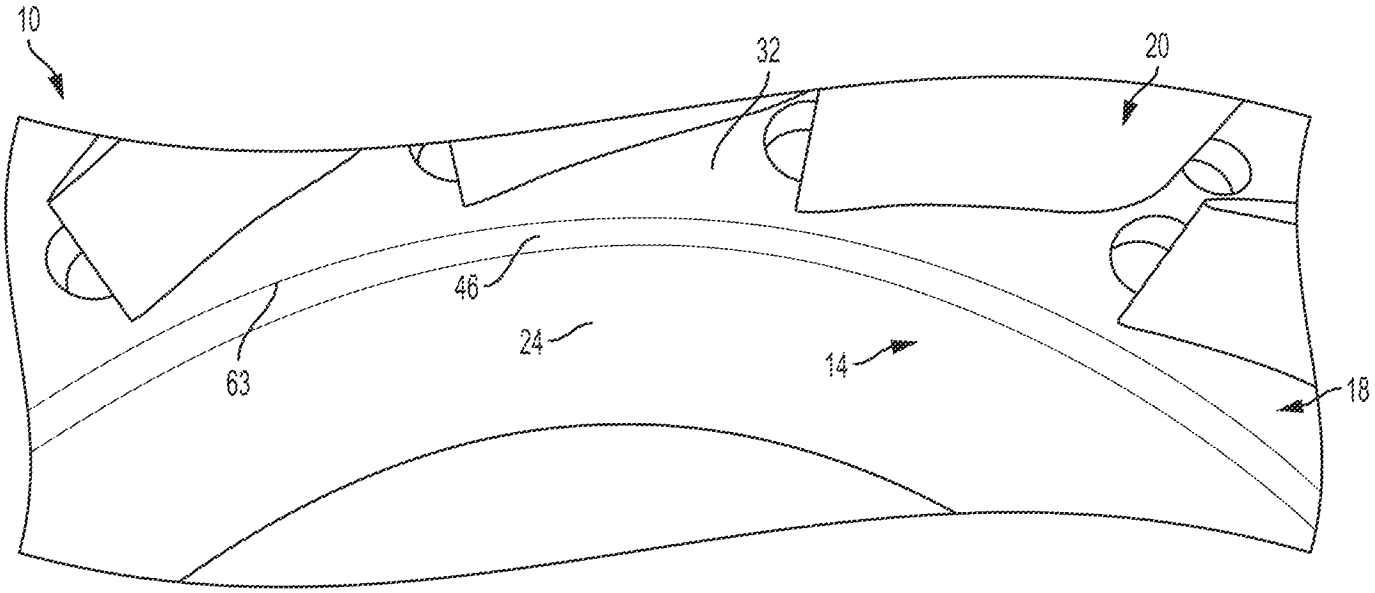
FIG. 7 is a perspective view of a nozzle ring repaired using the cut embodiment of FIG. 6.

FIG. 6 depicts another embodiment of a method according to the present disclosure wherein two cuts 58, 60 are formed into nozzle ring 10. Cut 58 is located farther from tip edge 42 of vane 20, which may inhibit the brazing material from climbing onto vane 20 during attachment of the replacement ring. Cut 58 extends from upper surface 32 of ring plate 18 into inner skirt 14 between inner surface 24 and outer surface 26. Second cut 60 is located below ring plate 18 and extends from outer surface 26 of inner skirt 14 to intersect with cut 58. In this manner, a shoulder 62 is formed on nozzle ring 10, providing two surfaces (i.e., the inward facing annular surface formed by cut 58 and the downward facing annular surface formed by cut 60) for attachment of the replacement ring. This may provide a stronger joint between the replacement ring and nozzle ring 10 than the joint formed using the method of FIG. 4. Additionally, using the cuts 58, 60 of FIG. 6, the braze material can be applied on an opposite side of vane 20. The braze bead 63 is shown on a repaired nozzle ring 10 in FIG. 7.

Figure 8:
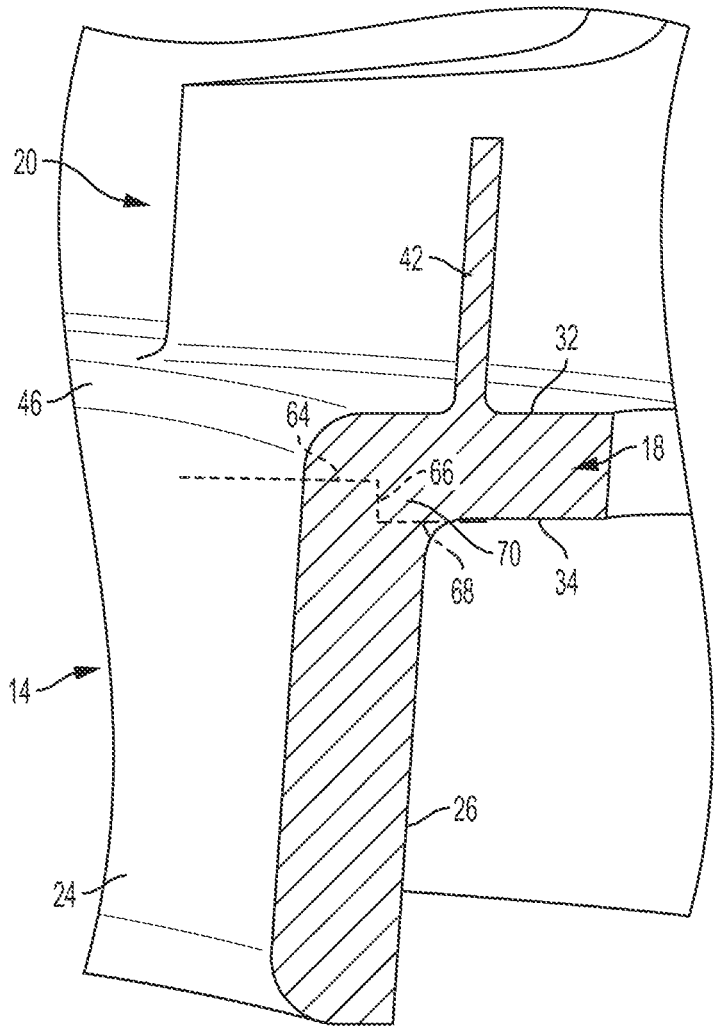
FIG. 8 is a cross-sectional view of a nozzle ring depicting cuts according to another embodiment of the present disclosure.
Figure 9:
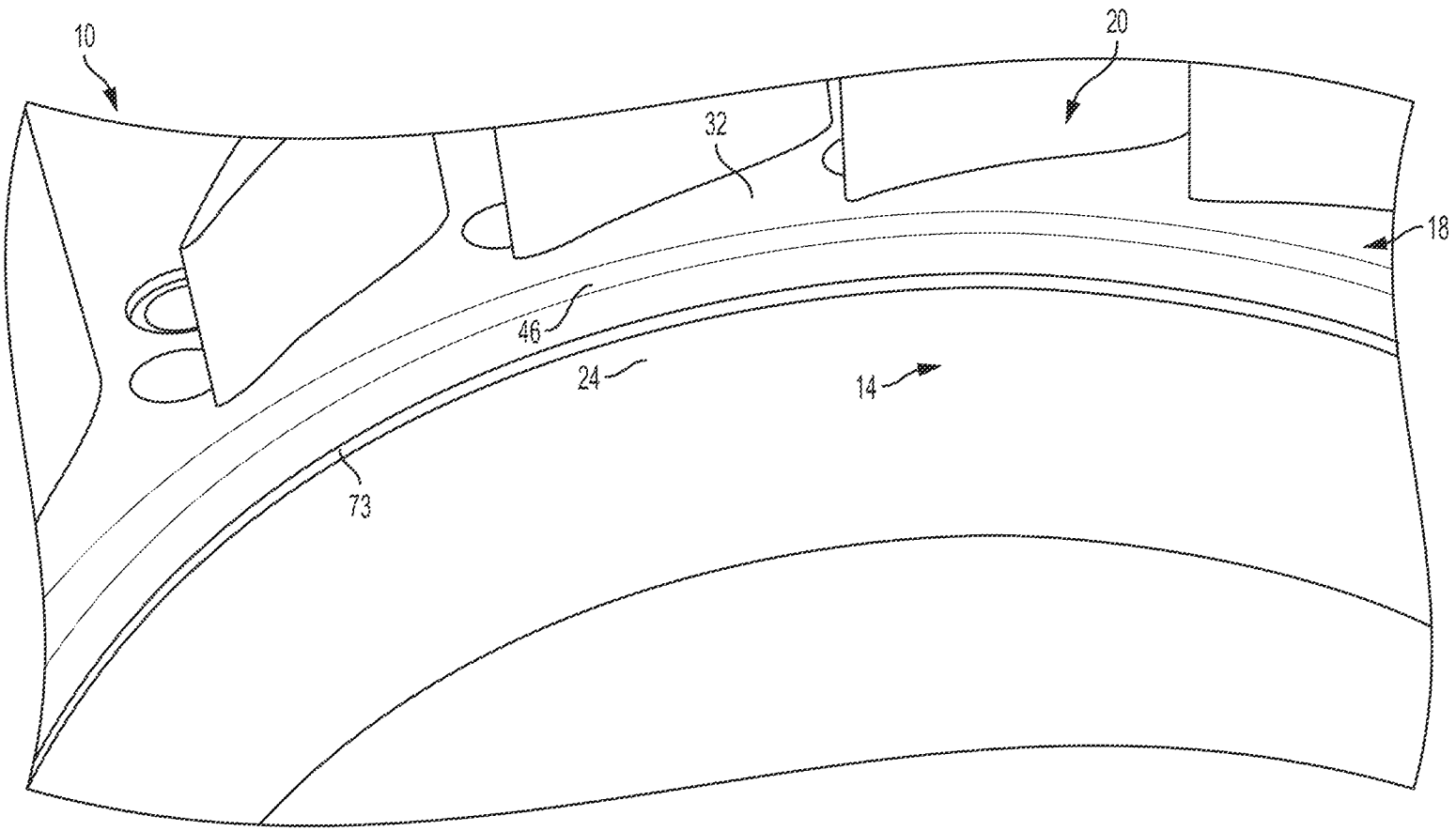
FIG. 9 is a perspective view of a nozzle ring repaired using the cut embodiment of FIG. 8.

FIG. 8 depicts another embodiment of a method according to the present disclosure. In this embodiment, a first cut 64 is formed into inner skirt 14 from inner surface 24, a second cut 66 is formed along inner skirt 14, and a third cut 68 is formed into inner skirt 14 from outer surface 26 substantially in the plane of lower surface 34 of ring plate 18 to intersect cut 66. In this manner, a shoulder 70 forms a joint having three connection surfaces when the replacement ring is attached to nozzle ring 10. The braze bead 73 is shown on a repaired nozzle ring 10 in FIG. 9.

Figure 10:
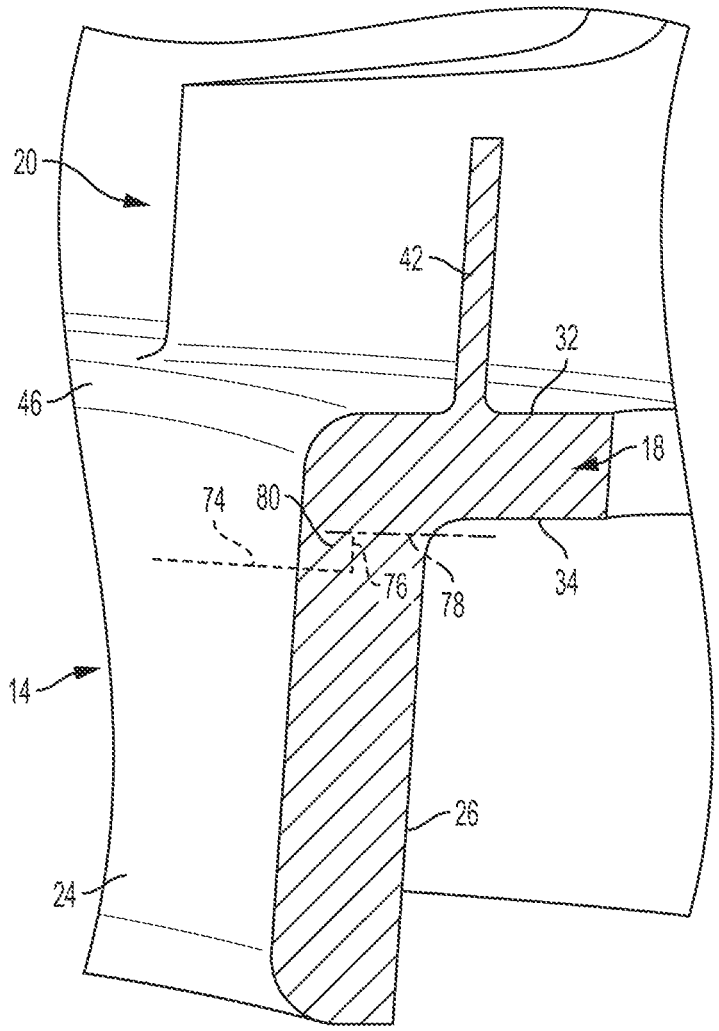
FIG. 10 is a cross-sectional view of a nozzle ring depicting cuts according to another embodiment of the present disclosure.

Referring now to FIG. 10, another embodiment of a method according to the present disclosure is shown. In this embodiment, a first cut 74 is formed into inner skirt 14 from inner surface 24, a second cut 76 is formed along inner skirt 14, and a third cut 78 is formed into inner skirt 14 from outer surface 26 below the plane of lower surface 34 of ring plate 18 to intersect cut 76. This forms a shoulder 80 which provides three connection surfaces when the replacement ring is attached to the nozzle ring 10.

Figure 11:
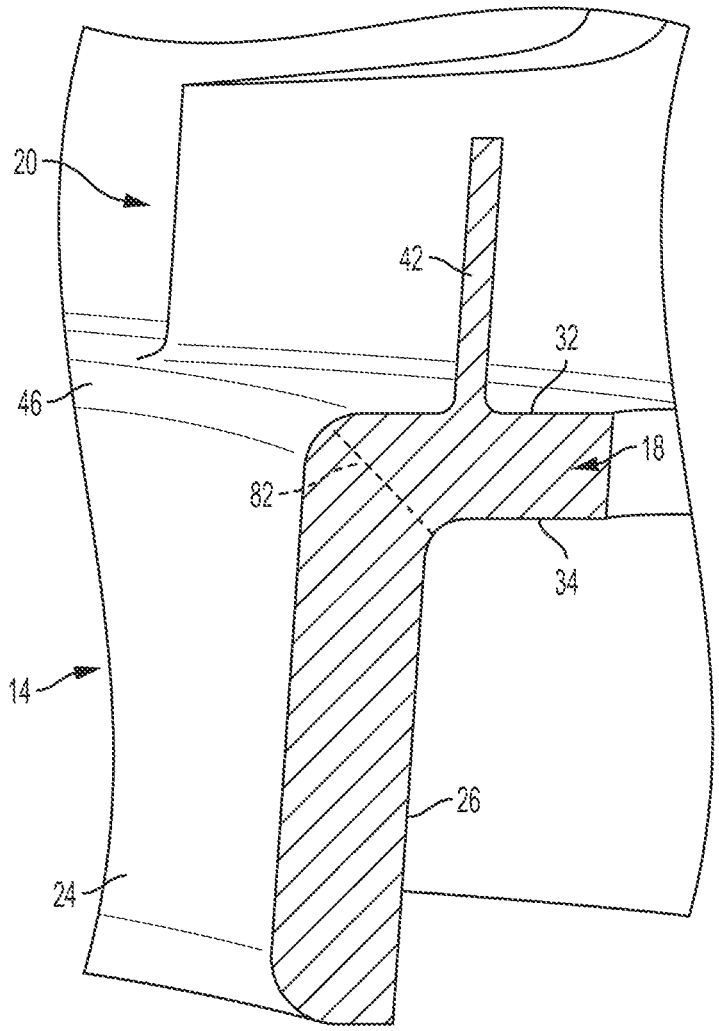
FIG. 11 is a cross-sectional view of a nozzle ring depicting a cut according to another embodiment of the present disclosure.

FIG. 11 depicts yet another embodiment of a method according to the present disclosure. In this embodiment, a single cut 82 is formed at a diagonal between transition 46 and a transition between outer surface 26 of inner skirt 14 and lower surface 34 of ring plate 18. By detaching inner skirt 14 in this fashion, the replacement ring may be laser welded to nozzle ring 10. The joint formed by cut 82 may be at an angle of approximately 45 degrees relative to the plane of lower surface 34 of ring plate 18. Of course, an angle of greater than or less than 45 degrees may be suitable for various applications.

Figure 12:
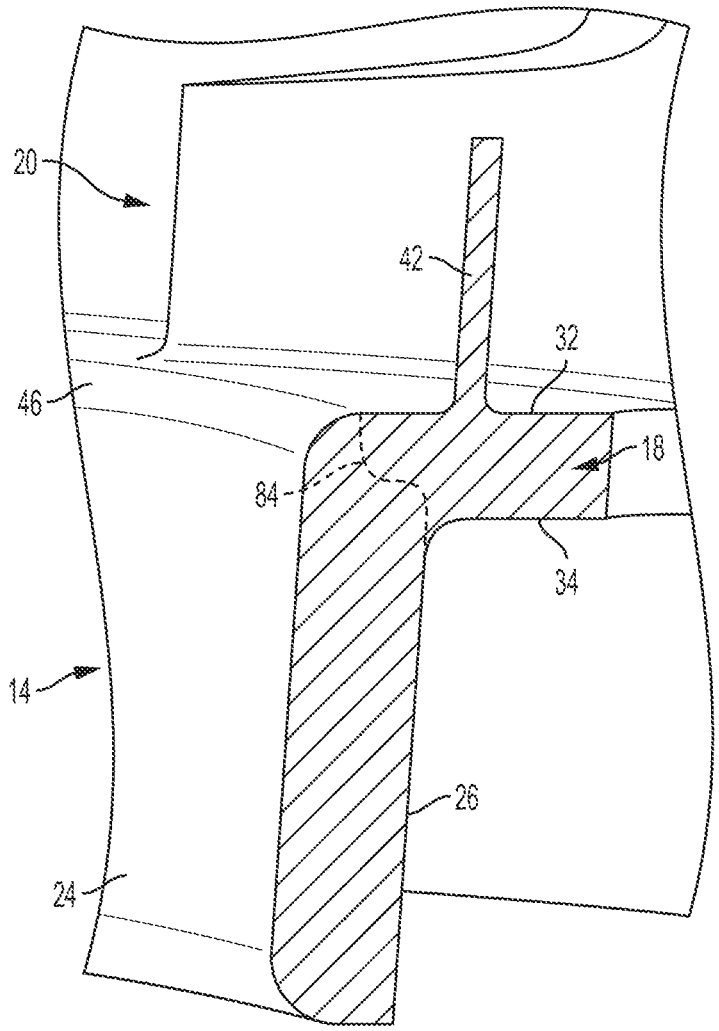
FIG. 12 is a cross-sectional view of a nozzle ring depicting a cut according to another embodiment of the present disclosure.

Finally, FIG. 12 depicts yet another embodiment of a method according to the present disclosure. In this embodiment, a single cut 84 is formed as a curved profile extending from upper surface 32 of ring plate 18 into inner skirt 14, then curving toward ring plate 18 and finally down through ring plate 18 substantially in the plane of outer surface 26 of inner skirt 14. Cut 84 results in removal of transition 46 and substantially all of inner skirt 14.

It should be understood that in the embodiments described above, although cuts are referred to as first, second and third cuts, the cuts do not need to be performed in any particular order, and more than one cut may be formed using a single pass of a cutting tool. It should further be understood that braze paste may be applied (such as by using a squeeze bottle) all along the joints formed between the replacement ring and nozzle ring 10.

Figure 13:
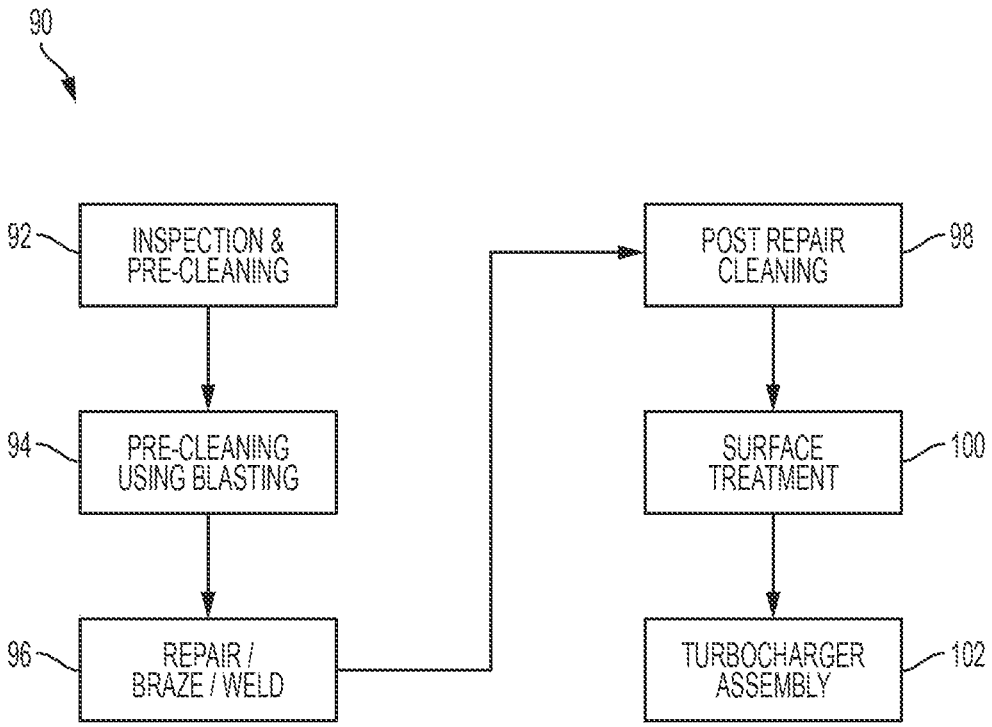
FIG. 13 is a flow diagram of a method of repairing nozzle rings according to the teachings of the present disclosure.

FIG. 13 depicts a process 90 according to one embodiment of the present disclosure which incorporates any of the cutting embodiments described above. In step 92, nozzle rings 10 are inspected to identify defects. If defects are identified, then the defective nozzle rings 10 are pre-cleaned to remove oily residue. Next, at step 94 the nozzle rings 10 are pre-cleaned using, for example, bead blasting. At step 96, the nozzle rings 10 are cut using any one of the methods described above with reference to FIGS. 4 through 12. New or refurbished replacement rings are obtained to match the cuts formed in nozzle rings 10, and the repaired nozzle rings are either brazed (using Nickle-based, Copper-based or other suitable braze material) or welded, depending upon the cut(s) formed for the repair. In other embodiments, the replacement rings may be attached using other techniques such as soldering, mechanical attachment or using adhesives. Collectively, all of these attachment connection mechanisms. At step 98, the repaired nozzle rings 10 are cleaned again, such as by bead blasting. At step 100, the repaired nozzle rings 10 may be treated to increase the hardness of the steel up to a certain depth. Various acceptable treatment methods are known to those skilled in the art. Finally, the repaired nozzle ring 10 is assembled into a turbocharger at step 102.

According to the teachings of the present disclosure, a reliable and effective repair of nozzle rings may be provided at a reasonable cost. The joints formed by the cutting methods provide effective surfaces for complete brazing, and the replacement rings may be formed or refurbished at a reasonable cost.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art with the benefit of the present disclosure to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

We claim:

1. A method for repairing a nozzle ring for a turbocharger having a defect adjacent a transition between a ring plate and an inner skirt of the nozzle ring, comprising:

forming at least one cut to detach at least one of a portion of the inner skirt, a portion of the transition, and a portion of the ring plate, thereby forming a joint surface and removing at least a portion of the defect; and attaching a replacement ring to the nozzle ring at the joint surface, the replacement ring including replacement components for the detached at least one of a portion of the inner skirt, a portion of the transition, and a portion of the ring plate.

2. The method of claim 1, wherein forming at least one cut comprises forming exactly one cut between an upper surface and a lower surface of the ring plate to detach the inner skirt, the transition and a portion of the ring plate.

3. The method of claim 1, wherein forming at least one cut comprises:

forming a plurality of cuts to detach at least one of a portion of the inner skirt, a portion of the transition, and a portion of the ring plate, thereby forming a joint surface and removing at least a portion of the defect.

4. The method of claim 3, wherein forming a plurality of cuts comprises forming a first cut into the inner skirt from an upper surface of the ring plate and forming a second cut into the inner skirt from an outer surface of the inner skirt to intersect the first cut to detach a portion of the inner skirt, the transition and a portion of the ring plate.

5. The method of claim 3, wherein forming a plurality of cuts comprises forming a first cut into the inner skirt from an inner surface of the inner skirt, forming a second cut along the inner skirt, and forming a third cut into the inner skirt from an outer surface of the inner skirt in a plane of a lower surface of the ring plate to remove a portion of the inner skirt.

6. The method of claim 3, wherein forming a plurality of cuts comprises forming a first cut into the inner skirt from an inner surface of the inner skirt, forming a second cut along the inner skirt, and forming a third cut into the inner skirt from an outer surface of the inner skirt in a plane below a plane of a lower surface of the ring plate to remove a portion of the inner skirt.

7. The method of claim 1, wherein forming at least one cut comprises forming exactly one cut between the transition and a transition between an outer surface of the inner skirt and a lower surface of the ring plate to remove the inner skirt and a portion of the transition.

8. The method of claim 1, wherein forming at least one cut comprises forming exactly one curved cut into the inner skirt from an upper surface of the ring plate and out of the inner skirt in a plane substantially the same as a plane of an outer surface of the inner skirt to remove the transition and substantially all of the inner skirt.

9. The method of claim 1, further comprising at least one of pre-cleaning the nozzle ring before forming the at least one cut and treating the nozzle ring to harden a surface of the nozzle ring after attaching the replacement ring.

10. The method of claim 1, further comprising treating the replacement ring to harden the replacement ring before attaching the replacement ring to the nozzle ring.

11. The method of claim 1, wherein attaching the replacement ring comprises using an attachment mechanism.

12. The method of claim 11, wherein using an attachment mechanism comprises forming the attachment mechanism by brazing using one of a Nickle-based braze material or Copper-based braze material.

13. The method of claim 11, wherein using an attachment mechanism comprises brazing or welding as the attachment mechanism.

14. A method of forming a nozzle ring for a turbocharger, comprising:

removing an inner skirt of an original nozzle ring at a joint, the removed inner skirt having a defect located adjacent a transition between a ring plate and the inner skirt of the original nozzle ring;

attaching a replacement inner skirt to the ring plate at the joint;

wherein removing the inner skirt of the original nozzle ring includes forming the joint by cutting the inner skirt of the original nozzle ring; and wherein attaching the replacement inner skirt includes one of welding or brazing the replacement inner skirt to the original nozzle ring at the joint.

15. The method of claim 14, wherein cutting the inner skirt of the original nozzle ring includes forming a first cut substantially parallel to an upper surface of the ring plate and forming a second cut substantially perpendicular to the upper surface.

16. The method of claim 15, wherein cutting the inner skirt of the original nozzle ring includes forming a diagonal cut relative to the upper surface.

17. The method of claim 14, wherein cutting the inner skirt of the original nozzle ring includes forming a curved cut between the inner skirt and the ring plate.

18. The method of claim 14, further comprising at least one of pre-cleaning the original nozzle ring before forming the joint and treating the nozzle ring to harden a surface of the nozzle ring after attaching the replacement inner skirt.

19. A nozzle ring for a turbocharger, the nozzle ring made by a process comprising the steps of claim 1.

20. A nozzle ring for a turbocharger, the nozzle ring made by a process comprising the steps of claim 15.

* * * * *